United States Patent [19]

Fassina

[11] 4,194,030

[45] Mar. 18, 1980

[54] METHOD FOR REINFORCING FABRIC BY APPLYING A FLUID REINFORCING MATERIAL THERETO

[75] Inventor: Cassiano Fassina, S. Mauro Torinese, Italy

[73] Assignee: Codama Holding S.A., Luxembourg

[21] Appl. No.: 841,079

[22] Filed: Oct. 11, 1977

Related U.S. Application Data

[63] Continuation of Ser. No. 635,544, Nov. 26, 1975, abandoned.

[30] Foreign Application Priority Data

Dec. 2, 1974 [IT] Italy ..... 70493 A/74
Jul. 23, 1975 [IT] Italy ..... 68918 A/75

[51] Int. Cl.[2] ..... B05D 5/00

[52] U.S. Cl. ..... 427/286; 118/212; 427/288

[58] Field of Search ..... 427/286, 288; 118/212, 118/213; 101/170

[56] References Cited

U.S. PATENT DOCUMENTS

| | | | |
|---|---|---|---|
| 761,520 | 5/1904 | Matthew | 427/286 X |
| 1,112,134 | 9/1914 | Hansing | 118/212 X |
| 2,116,289 | 5/1938 | Shepherd | 118/212 |
| 2,428,113 | 9/1947 | Grupe | 118/212 |

FOREIGN PATENT DOCUMENTS

| | | | |
|---|---|---|---|
| 1025463 | 6/1966 | United Kingdom | 427/286 |
| 1201941 | 2/1970 | United Kingdom | 427/288 |

*Primary Examiner*—Evan K. Lawrence
*Attorney, Agent, or Firm*—Sughrue, Rothwell, Mion, Zinn and Macpeak

[57] ABSTRACT

A method and apparatus for reinforcing a fabric, wherein a grooved printing member prints on the fabric a strongly directional pattern of lines of fluid reinforcing material having a Brookfield viscosity of from 10,000 to 25,000 centipoise, the reinforcing material being set or cured in a heater.

20 Claims, 9 Drawing Figures

METHOD FOR REINFORCING FABRIC BY APPLYING A FLUID REINFORCING MATERIAL THERETO

This is a Continuation, of application Ser. No. 635,544, filed Nov. 26, 1975, abandoned.

BACKGROUND OF THE INVENTION

In the method of reinforcing a fabric with a settable or curable fluid reinforcing material a printing roller having a plurality of blind grooves therein is located a predetermined distance from a backing roller. The fluid material is supplied to the grooves and a fabric having a thickness at least equal to the predetermined distance is fed between the rollers. The predetermined distance is maintained constant during the entire passage of the fabric between the rollers during the printing operation so that the printing roller engages the fabric with a pressure dependent on the thickness of the fabric and the fluid material penetrates into the fabric a distance dependent on said pressure. The fluid material is then set or cured to form an elastomeric or plastic material firmly adhering to and reinforcing said fabric.

The invention also relates to apparatus for applying the pattern to the fabric and subsequently setting or curing the material, the apparatus including a backing member for supporting the other face of the fabric in order to enable the pattern to be applied to the first face of the fabric, and an arrangement for subsequently substantially setting or curing the material applied to the fabric.

British patent specification No. 1,201,941 discloses printing a plastic onto the underside of a top cloth in order to form a substitute for an interlining. The resin is formed into a paste which is applied to the top cloth using an apertured sheet or an apertured roller to whose interior the paste is supplied. The sheet or roller has a precisely defined pattern of 1.2 to 3 mm diameter holes which print on the part of the top cloth in question reinforcing material of different densities in order to represent the characteristics of different types of interlining.

It has been found that the method and apparatus described in British patent specification No. 1,201,941 is not suitable for large scale production, mainly because the very specific printing patterns which are required mean that different printing or applying members are necessary for every different piece of a garment, and also for every different garment size. In addition, British patent specification No. 1,201,941 gives no details of the properties of the material being printed onto the fabric, and it is found in practice that the successful operation of the apparatus depends upon the properties of the material being applied, as well as on factors such as the printing pressure.

Furthermore, the specific printing patterns disclosed in British patent specification No. 1,201,941 are formed by two intersecting series of parallel lines with relatively large circular spots at the intersections of the lines. The lines need not be strictly at right angles, and in this case the pattern will have some directional characteristics, for example will have different tensional properties and springiness in different directions, but in general, the directional characteristics of the reinforcing will be relatively small compared with those imparted to a fabric by conventional interlinings.

SUMMARY OF THE INVENTION

It is a general object of this invention to provide a method which can be used for the large scale application of reinforcing material to fabrics, and also to improve the characteristics of the reinforcement itself.

According to the present invention the method of reinforcing a fabric comprises providing a printing member having a plurality of blind grooves in the printing face to form a printing pattern, locating the backing member a predetermined distance from said printing member to receive said fabric therebetween, supplying settable or curable fluid reinforcing material having a Brookfield viscosity of between 10,000 and 25,000 centipoise to said grooves, feeding a fabric having a thickness at least equal to said predetermined distance between said backing member and said printing member and maintaining said predetermined distance during the entire printing operation so that said printing face engages a face of said fabric located between said printing member and said backing member with a pressure dependent on said thickness thereby printing an amount of said fluid reinforcing material onto said fabric and penetrating said fluid reinforcing material into said fabric a distance dependent on said pressure in a pattern corresponding to the pattern on the printing member and substantially setting or curing the pattern of reinforcing material to form an elastomeric or plastics material firmly adhering to and reinforcing said fabric.

In accordance with the foregoing method, a plurality of different thickness fabrics, each of which has a thickness at least equal to the predetermined distance between the backing member and the printing member, can be fed between the rollers while maintaining the same predetermined gap. In this way the pressure exerted by the printing roller on the fabric will vary in accordance with the thickness and the fluid reinforcing material will penetrate into the respective fabric the proper distance in accordance with the pressure exerted thereon.

DESCRIPTION OF THE PREFERRED EMBODIMENTS

Figure 1:
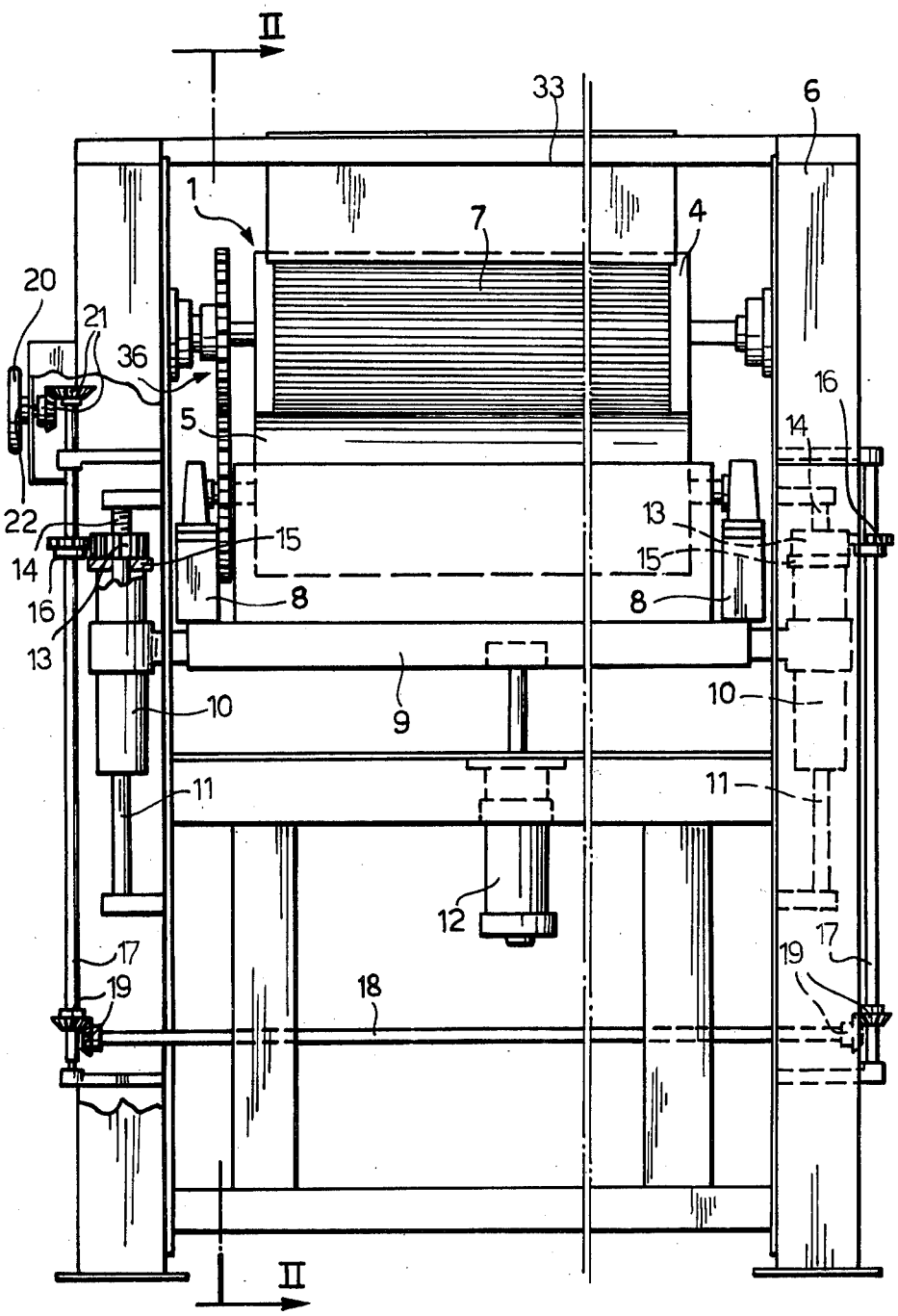
FIG. 1 is an end view of an apparatus for carrying out the method of the invention.

According to one feature of the invention, the reinforcing material is applied to the fabric using a printing member which has a configuration, corresponding to the pattern to be applied to the fabric, extending substantially over the whole of its face, but which printing member cooperates with the material at spaced positions so as to apply the pattern to at least one limited, discrete area of the fabric. In this way, the same printing member can be used to apply the reinforcing material to any number of different pieces, for instance cut pieces, of fabric, and the fabric can be suitably oriented so that the pattern runs in the correct direction with respect to for instance the weft of the fabric. The printing member is preferably a printing cylinder.

In accordance with this feature of the invention, the apparatus may be arranged such that a large gap can be formed between the applying member and the backing member so that the fabric can be drawn past the applying member without the pattern being applied to relevant areas of the fabric, enabling the pattern to be applied to at least one other limited, discrete area of the fabric.

According to another alternative or complementary feature of the invention, the reinforcing material is applied to the fabric in the form of a pattern of continuous or discontinuous parallel lines, preferably with no connections between the lines in a direction transverse to the lines, which pattern extends substantially right across the fabric to which the reinforcing material is being applied. Such a reinforcement is highly directional and gives the fabric a different handle in different directions, enabling the reinforced fabric to have the characteristics of a fabric reinforced in a traditional manner with the traditional interlining such as what is known as "canvas;" "canvas" interlining is a woven fabric with a warp and weft of different yarns in such a way as to have some elasticity in the weft direction but substantially no elasticity in the warp direction. The normal arrangement is to sew or bond the "canvas" interlining behind for instance the front panel (forepart) of a jacket with its weft running horizontally. Using the invention, the continuous or discontinuous lines can run horizontally (that would be parallel to the weft direction of the fabric of the top cloth), leaving the fabric supple when bent about horizontal lines but making the fabric very springy when bent about vertical lines. In addition, the lines can be applied specifically to for instance the cuff of a jacket or bottom of a trouser leg in order to make it easy to fold the cuff or bottom for shortening or lengthening the sleeves or legs, the fold line being between the lines of reinforcing material.

The reinforcing material has a Brookefield viscosity, as defined hereafter, which may be of a narrower range of between 13,000 and 20,000 centipoise. Using this range of viscosity, it is found that the penetration into the fabric can be controlled while printing rapidly using the printing member, and the operation can be carried out as a normal commercial operation.

Instead of using a printing cylinder which has grooves extending for the whole of its length, the grooves could extend for say two fifths of its length so that uncut cloth could be printed across two fifths of its width, the pieces of garment subsequently being cut from this cloth, although this can make cutting difficult and is rather wasteful of reinforcing material. In an even more wasteful method which nevertheless has advantages over the prior art, the whole width and length of the uncut cloth could be printed with reinforcing material.

As another instance, the lines of the pattern may in some cases be interconnected by parts of the pattern which extend transversely to the lines. As a further instance, any suitable printing member could be used to print onto the fabric a pattern whose shape corresponded to the parts or panels to be cut out, and on which the lines of the patterns on the different parts or panels need not run parallel to each other.

In general terms, the method of the invention can be used on the uncut fabric or upon pieces (parts or panels) which have been cut for a garment. However, it is preferred to use the method on the cut pieces.

TYPES OF GARMENT AND FABRICS

The invention is primarily applicable to men's and women's outer garments such as jackets and overcoats, but may also be used for garments such as shirts where the reinforcing material can be applied to the collar, cuff and button strip down the front, and for accessories such as ties. The invention is applicable to a wide range of weights of fabric, from shirt fabrics, through lightweight summer suiting to heavyweight overcoat cloth. The invention can also be applied to interlining material, such as felt for the chest, collar and/or shoulder pads of a jacket. In the particular case where an interlining is used, the reinforcing material could be applied to the inside of the top cloth and the top cloth be bonded to the interlining using the reinforcing material, either during the initial setting or curing stage or, if the reinforcing material has some residual thermoplastic properties, during a further heating stage.

The fabric can be constructed in any suitable manner, for instance woven, knitted or felted, and can be of any suitable material, such as wool, silk, cotton or mixtures of natural and synthetic fibres.

PATTERN OF REINFORCING MATERIAL APPLIED

The preferred pattern is a pattern of continuous or discontinuous parallel lines, preferably with no connections between the lines in a direction transverse to the lines, and it is most convenient if the lines are equispaced.

In general, the configuration on the applying member preferably includes lines about 1 millimeter wide, and again preferably parallel lines with a spacing of about 1 millimeter between the lines, so the pattern printed includes lines of about 1 millimeter wide or slightly wider, depending upon the spread of the reinforcing material, and a spacing of about 1 millimeter, or slightly less, between the lines.

In specific instances, such as at the collar of the back panel of a jacket, the lines may extend at an angle of less than 90° to both the warp and the weft direction of a woven fabric. Nonetheless it has been found that for most parts of a garment, it is best to have the lines extending parallel to the weft or nearly parallel to the weft, and for this reason, it is found preferable that the pattern should include parallel lines which extend transverse to the direction of movement of the fabric past the applying member; in the specific case of a printing cylinder, it is relatively simple to machine grooves running parallel to the cylinder axis, though it would be feasible to machine differently orientated lines, for example diagonal lines or circumferential lines, on a printing cylinder.

The strength of the reinforcement or its directionality can be modified by applying the pattern twice to the fabric, either on the same side or (particularly in the case of an interlining) on different sides; the fabric can be turned so that the two patterns run at 90° to each other. In general it is found that printing patterns at 90° to each other on different sides of an interlining fabric give a better handle than printing such patterns both on one side.

AMOUNT OF REINFORCING MATERIAL APPLIED

In general, for lighter weight and finer fabrics, less reinforcing material or a thinner layer thereof is wanted, and the amount of reinforcing material depends upon factors such as the density of the fabric, the viscosity of the reinforcing material, the effective surface tension between the reinforcing material and the fibres of the fabric, and the pressure with which the reinforcing material is applied.

In general, it is however found that for a fabric, preferably a woven fabric, which may be used for instance for a jacket or trousers, the weight of the cured material on the fabric is preferably between 15 and 60 g/m$^2$ (gms per square meter of the fabric), though in specific cases, such as for interlinings, this figure may rise to as much as 100 g/m$^2$.

Broadly, the ratio of the weight of the cured material to the weight of the fabric (as weighed without the reinforcing material) is preferably between 7.5% and 20%, or even 30%, though for normal fabrics such as woven fabrics, this range is preferably between 9% and 16%.

The amount of set or cured reinforcing material on the fabric can be represented as the weight of the material per meter of line if the pattern includes lines, and it is found that good results are obtained with a weight between 0.04 and 0.15 gms per meter of line, a preferred range being 0.06 to 0.10 gms for a woven top cloth or even for felts.

To achieve these ranges of weight, if the applying member is a plate or cylinder having grooves therein, the grooves are preferably 0.05 to 1 mm deep, or more preferably 0.25 to 0.35 mm deep, though the actual amount of reinforcing material transferred from the grooves to the fabric depends upon the pressure of the printing and upon the nature of the fabric itself.

A predetermined gap is established between the applying member and a backing member for supporting the other face of the fabric, and in general the gap is preferably between 0.1 and 0.5 mm wide, and it has been found that with this range the reinforcing material can be applied satisfactorily to most normal fabrics, a somewhat smaller range having a maximum of 0.4 mm. In general terms, the greater the pressure, the greater the penetration, and for very fine fabrics, such as shirt fabrics, no pressure need be applied by the applying member, the gap being very slightly greater than the thickness of the fabric.

With the choice of a suitable gap, the same gap can be used for a relatively thick, open weave and for relatively thin, close weave, and it has been found that a gap of about 0.15 mm can be used for a wide range of fabrics, the thick fabrics being pressed strongly, thereby ensuring good penetration of the reinforcing material into the fabrics, and the thin fabrics having less penetration of the reinforcing material.

PRINTING SPEED

If the applying member is a printing cylinder, a maximum convenient printing speed is about 20 meters per minute, and the printing cylinder preferably has an adjustable peripheral speed up to this maximum.

REINFORCING MATERIAL

In general, any suitable resin or elastomer may be used, and any form or solution or dispersion and any form of setting or curing.

However, the reinforcing material is preferably applied in a form which is dispersible in water, is preferably heated for setting or curing, and is preferably set or cured below 150° to 160°, in under five minutes, the preferred arrangement being to set or cure at 140° to 150° C. immediately or soon after applying the reinforcing material, the application being at room temperature.

The preferred material is a heat-curable polyacrylic-type resin, i.e. a resin whose monomers contain the acrylic group, such as acrylic acid itself, acrylamide, acrylonitrile, or acrylates such as ethyl acrylate or butyl acrylate.

Any suitable cross-linking agent can be added, the preferred cross-linking agent being a melaminic agent if the reinforcing material comprises a polyacrylic-type resin. The set or cured material should have a high degree of cross-linking, and preferably should not be sticky or tacky below 120° C. The set or cured material must be resistant to dry cleaning fluid.

If desired, the material can be foamed, for instance by bubbling air into the material before supplying the material to the applying member; however, foaming is not preferred.

PENETRATION INTO THE FABRIC

The strength of the reinforcing material is derived from a combination of the cured or set reinforcing material and the fabric fibres embedded therein, and in general, the greater the penetration, the greater the reinforcement and the springness fo the fabric. With very light, nearly translucent fabrics such as shirt fabrics, there should be virtually no penetration, the reinforcing material just adhering to the fine nap or pile of the fabric. However, in general, a penetration of 10 to 33% of the thickness of the fabric is found most suitable.

As indicated above, the penetration depends on factors such as the viscosity of the reinforcing material, the type of fabric and the pressure of the applying member.

VISCOSITY

For liquid borne reinforcing materials, the viscosity as measured varies with the type of apparatus used, and with the rate of deformation of the material because the material has thixotropic properties.

However, it has been found that a useful indication is given in accordance with A.S.T.M. D 1824-61T, though instead of the test conditions set out in the A.S.T.M. standard, a Brookfield Model RVK viscometer is used with spindle No. 4 and a speed of 5 r.p.m. and the temperature is the temperature at which the reinforcing material is to be applied. The term "Brookfield viscosity" as used herein means the viscosity measured in this manner. It has been found that the Brookfield viscosity should be broadly within the range of 10,000 to 25,000 centipoise, or in a narrower range of 13,000 to 20,000 centipoise. It has been found that operation within a range of 15,000 to 17,000 centipoise gives good results, the preferred Brookfield viscosity being about 16,000 centipoise. 17,000 centipoise can be used with very light pressure for very light fabrics and 15,000 centipoise used with heavy pressure for heavy fabrics. Other viscometers may give markedly different results. For instance, a type VT-OZ Haake viscometer with rotor No. 1 and scale No. 1 gave a viscosity of 3,500 centipoise for a reinforcing material having a Brookfield viscosity of 16,000 centipoise, and, using such a Haake viscometer, a useful range was found to be 2,900 to 3,700 centipoise. One poise is 1 $cm^{-1}$ gm $s^{-1}$.

The viscosity can be controlled by the amount of inert liquid, such as water, added, or by adding a thickener such as a cured acrylic-type resin. Although a certain amount of viscosity is required to prevent undue penetration, it is found that if the material is too viscous, too much of the material will remain on the surface of the fabric and is tacky even when much filler is added; in addition, there may be difficulties in for instance cleaning nonprinting areas of the applying member.

The actual tackiness of the reinforcing material can be controlled by an inert filler such as a mineral like talc or titanium dioxide, or, less preferably, powdered asbestos alumina; the filler also controls the amount the reinforcing material spreads when applied to the fabric, that is to say the stability of the impression on the fabric. The filler preferably has over 90% w/w of its particles coarser than 1μ particle size and 50% thereof coarser than 5μ particle size as very fine powders do not alter the tackiness and spread appreciably, whilst the larger particle sizes impart more springness but suppress the tackiness.

The admixture of a fine filler having substantially all its particles below a particle size of 1μ, for instance pigment grade titanium dioxide, is found to be beneficial, apparently increasing the rigidity of the set or cured reinforcing material. The preferred amount of fine filler is 0.5 to 1% w/w of the fluid reinforcing material, or, if the coarser filler is also present, 5% to 100% of the weight of the coarser filler, preferably about 10%.

APPLICATION OF FLOCK OR POWDER

Any suitable short fibre or particulate material, such as flock or powder, can be applied to the reinforcing material before the reinforcing material has been cured or set. The short fibre or particulate material can reduce tackiness, or increase the apparent thickness of the fabric, or give the fabric a softer handle.

EXAMPLE 1

The following is an example of a reinforcing material formulation which can be used in the practice of the invention. The parts and percentages are by weight. The material had a Brookfield viscosity, as defined hereinbefore, of 16,000 centipoise, the measurement being done at 20° C.:

| | |
|---|---|
| water | 20 |
| talc, 8% <1 μ, 9% 1-2 μ, 29% 2-5 μ, 40% 5-10 μ, 14% 10-20 μ, about 0.2% >20 μ (5/L MTIZO grade talc supplied by Talco Grafite Val Chisone S.p.A., of Pinerolo, Italy) | 11 |
| titanium dioxide, pigment grade, particle size less than 1 μ, namely about 0.3 to 0.4 μ (Tioxide R-HD4, supplied by Chimica Strola S.n.c., of Turin, containing 91% titanium dioxide, balance compounds of aluminium, zinc and silicon, specific gravity 4.0) | 1 |
| 45:55 acrylic-type resin : water emulsion (Fiberfix HF resin manufactured by A.I.C. S.p.A. (Approvvigionamenti Industriali Chimici S.p.A. of Turin) - "Fiberfix" is a Trade Mark)* | 76 |
| melaminic cross-linking agent containing 60% of trimethoxy-trimethylol-melamine (Melasin 80 manufactured by A.I.C. S.p.A. - "Melasin" is Trade Mark) | 3.5 |
| thickener in the form of an aqueous emulsion containing 28% of a cured (cross-linked) copolymer of methacrylic acid and ethyl acrylate (Thickener 56 manufactured by A.I.C. S.p.A.) | 7.5 |
| 10% oxalic acid: water solution (accelerator) | 0.7 |
| ammonia, to adjust pH to 8 | 3 |

*This resin had a molecular weight of 40 to 80 million, and is formed by polymerization in aqueous emulsion of 83% butyl acrylate, 12% acrylonitrile and 5% of a cross-linking agent consisting of an acrylic monomer carrying methylol groups. The emulsifying system is an anionic emulsifying system consisting of a mixture of alkylarylpolyglycolates, fatty alcohols condensed with ethylene oxide, and sulphonated surfactants.

The apparatus for carrying out the method of the invention includes a roll stand 1, a feeding device 2 for feeding the fabric through the roll stand 1 and a heater 3 for curing the reinforcing material applied to the fabric.

Figure 2:
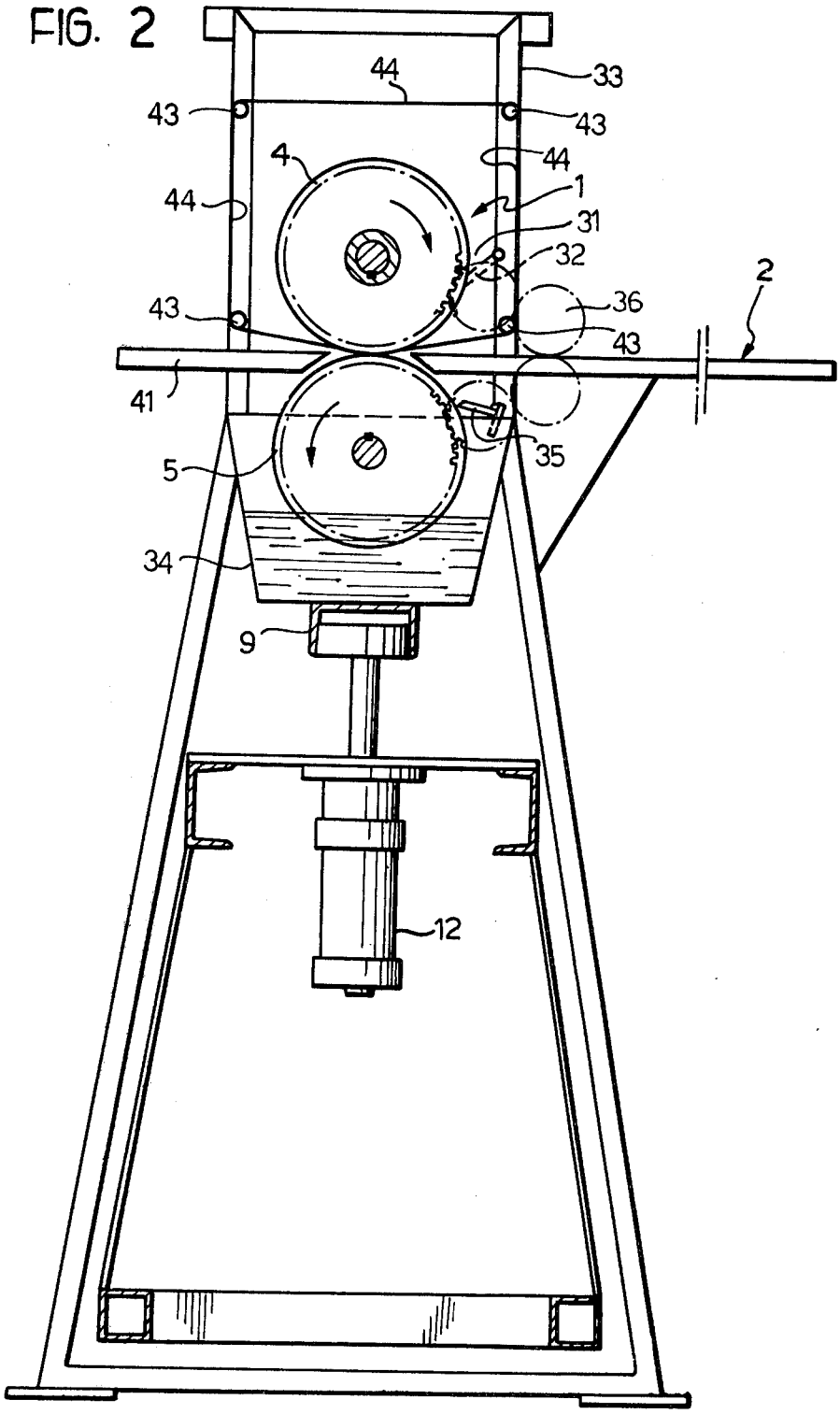
FIG. 2 is a vertical section along the line II—II of FIG. 1.
Figure 3:
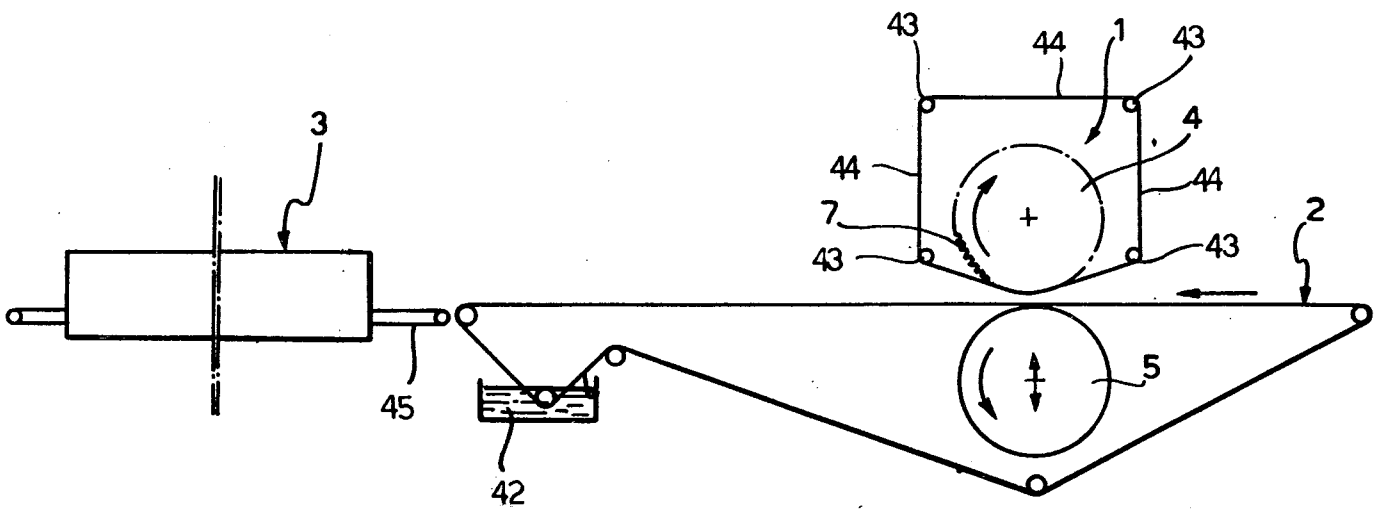
FIG. 3 is a schematic side view, showing a modification of the apparatus.

The heater 3 is not shown in FIGS. 1 and 2, but is indicated in FIG. 3.

As shown in FIGS. 1 and 2, the roll stand 1 mounts printing roll means comprising an applying member in the form of a rotary printing cylinder 4 and a backing member in the form of a pressure roll 5. An adjustable speed motor drive 6 is provided for driving the printing cylinder 4. As an example, the printing cylinder may be 60 cm long and have a diameter of 20 cm, the motor drive 6 being adjustable to give a maximum cylinder speed of 22 r.p.m., i.e. a maximum peripheral speed of 14 meters per minute. As an example of the printing configuration on the printing cylinder 4, the printing cylinder 4 can be machined with a pattern of blind longitudinal grooves 7 (indicated in FIG. 1) which extends all the way round its periphery and for substantially the whole of its printing length (leaving smooth end portions); the grooves may be 0.30 mm or 0.35 mm deep, be of rectangular cross-section, have a width of 1 mm and have a spacing of 1 mm between the grooves.

The pressure roll 5 is mounted on movable mounting means in the form of two small pedestals 8 which are carried on a cross-beam 9 which is guided for strictly vertical motion by two guide sleeves 10 which are fixed to the cross-beam 9 and which slide on cylindrical guide columns 11 fixed to the roll stand 1.

A double-acting pneumatic ram 12 is connected to the cross-beam 9 in order to act as a device for rapidly lowering the pressure roll 5 from the printing cylinder 4 and for returning the pressure roll 5 to a printing position. Two adjustable abutments are provided for limiting the upwards travel of the cross-beam 9 and pressure roll 5, and therefore defining the roll gap, these abutments being manually adjustable to provide a roll gap of between 0.1 mm and 0.4 or 0.5 mm.

The adjustable abutments can be of any suitable type, but in the apparatus illustrated, each is in the form of a gear pinion 13 screwed onto a screw-threaded upper end 14 of the respective guide column 11 and forming a stop for an abutment member 15 on the upper end of the guide sleeve 10. A further gear pinion 16 meshes with each respective pinion 13, the pinion 16 being axially fixed but the respective axial lengths of the pinions 13 and 16 being such that the pinions remain in mesh as the pinion 13 is screwed up and down. Each pinion 16 is fixed to a vertical shaft 17, and the two shafts 17 are coupled by a cross-shaft 18 and two sets of bevel gears 19. The left-hand shaft 17 (as seen in FIG. 1) is connected to a hand-wheel 20 by means of a bevel gear 21 and a short horizontal shaft 22 so that rotation of the hand-wheel 20 causes the abutment pinions 13 to rotate and move up and down the guide columns 11.

The pneumatic ram 12 can be connected to a manual control, in which case the operator judges by eye where the reinforcing material should be printed, or to an automatic control actuated by the passage of the fabric through the roll stand. The arrangement is such that when the cross-beam 9 is withdrawn, there is a sufficiently large gap between the pressure roll 5 and the printing cylinder 4 to prevent the fabric having the reinforcing material printed thereon.

A solution, emulsion or suspension of the reinforcing material is supplied to a reservoir 31 which is retained by a ductor blade 32, ensuring that the grooves 7 in the printing cylinder 4 are filled with reinforcing material and wiping clean the lands between the grooves. If desired, though not essential, a hood 33 can be provided over the printing cylinder 4, and the hood 33 can cover washing devices (not shown) for washing the printing cylinder 4 on shut-down. Likewise, though not essential, the pressure roll 5 can be mounted within a bath 34 of washing liquid, for continuously washing the pressure roll 5 during the operation of the apparatus; a wiper blade 35 bears against the pressure roll 5, to remove any washing liquid adhering to the pressure roll 5.

The pressure roll 5 is driven from the printing cylinder 4 by a gear train 36 only part of which is illustrated in FIG. 1 and which is only illustrated schematically in FIG. 2. The gear train 36 is arranged to remain in mesh at all positions of the pressure roll 5 so that the pressure roll 5 continues to rotate even when it is lowered.

In FIG. 2, the feeding device 2 is a stationary feed table, for passing the fabric, and in particular pieces of cut fabric, through by hand, a small receiving table 41 being indicated in FIG. 2. The fabric can then be carried by hand and inserted into the heater 3 in any suitable manner. However, for larger scale production, the feeding device 2 illustrated schematically in FIG. 3 is used, the feeding device 2 being in the form of a conveyor belt which passes over the top of the pressure roll 5 and is driven by the pressure roll 5, the conveyor belt passing through a washing bath 42. In this case, the belt covers the surface of the pressure roll 5, and is raised by the pressure roll 5 when the pressure roll 5 is raised. It is not necessary to have any bath 34 for cleaning the pressure roll 5.

FIGS. 2 and 3 illustrate an arrangement for preventing the fabric tending to cling to the printing cylinder 4. Four rollers 43 extend across the width of the printing cylinder 4, and guide a number of loops of filamentary material 44 past the printing cylinder 4 so that they leave the surface of the printing cylinder 4 shortly after the position at which the periphery of the printing cylinder 4 is closest to the pressure roll 5, thereby ensuring that the fabric is detached from the printing cylinder 4. There may be four loops of the filamentary material 44, their lateral position being fixed by means of shallow annular grooves in the rollers 43. The filamentary material 44 may be 0.12 mm diameter nylon monofilaments, which have been found not to mark the fabric appreciably, even when the roll gap was only 0.1 mm.

The heater 3 is shown in FIG. 3 as being provided with a feeding device 45, but the heater 3 can be of any suitable type. For instance, the heater 3 can be a simple radiant heater which heats the reinforcing material to 140° to 150° C. for three to five minutes, though if the reinforcing material cures or sets at a lower temperature or at the ambient temperature, the dimensions and hence the through-put time, of the heater 3 can be correspondingly reduced. If the reinforcing material is self-curing or self-setting at the ambient temperature, it is still desirable to incorporate a heating step, to hasten the setting or curing.

DETAILED DESCRIPTION OF REINFORCED FABRICS

Figure 5:
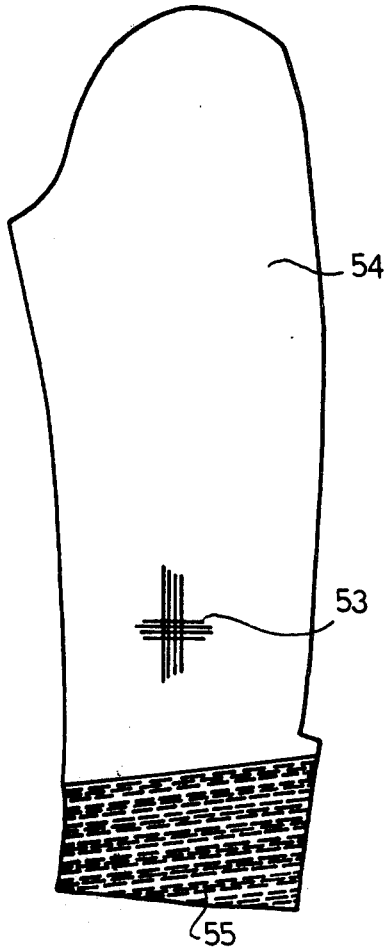
FIGS. 4 to 8 illustrate pieces of fabric which have been reinforced in accordance with the invention.
Figure 4:
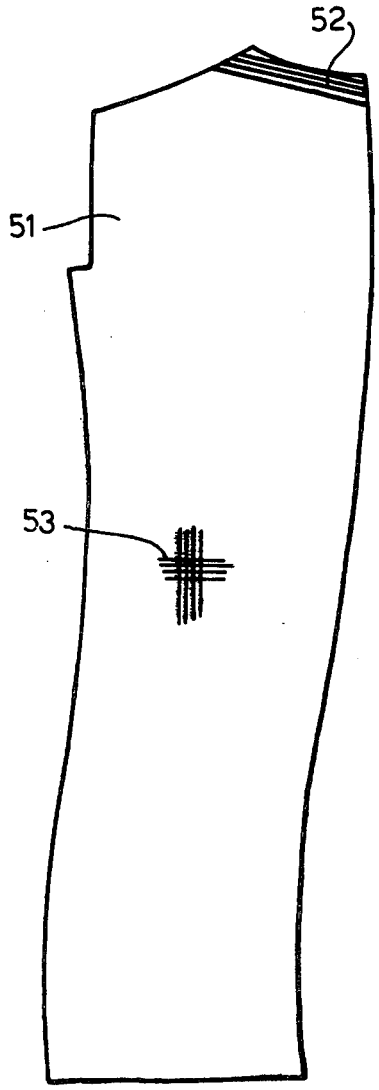
Figure 6:
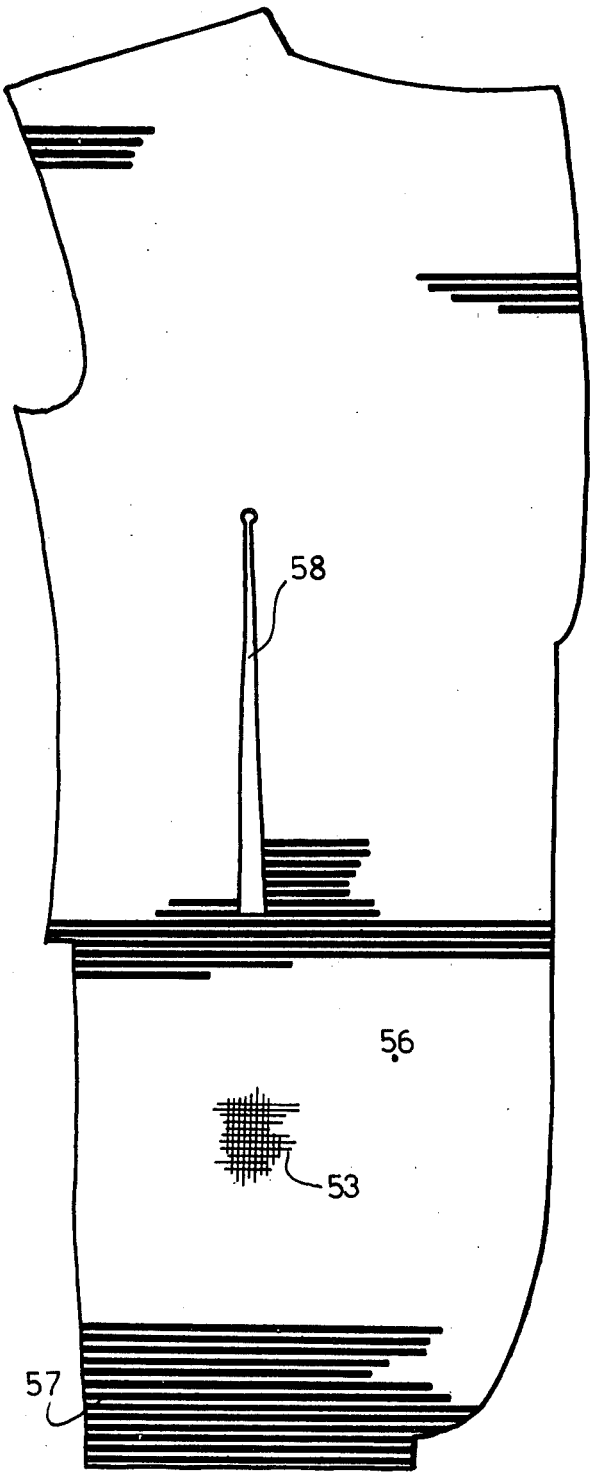

In FIGS. 4 to 6, the pattern of reinforcing material is shown on a larger scale than the piece of fabric itself.

FIG. 4 illustrates the right-hand back panel 51 of a jacket which has been reinforced using the apparatus of FIGS. 1 and 2. The panel was cut before being fed through the roll stand 1, and was turned so that its warp direction was at about 12° to the longitudinal direction through the roll stand. For most of its passage through the roll stand 1, the pressure roll 5 was withdrawn, but the pressure roll 5 was brought up for a brief moment in order to print parallel lines 52 of reinforcing material at the collar of the panel 41. It will be seen that the lines 52 run at about 12° to the weft direction (indicated at 53), though this angle could be increased to say 30° if desired.

The lines 52 at the collar are not primarily for altering the handle of the fabric, but assist the tensile properties of the fabric in this area.

It will be appreciated that the lines 52 of reinforcing material can run strictly parallel to the weft direction 53 in other pieces or panels, and this would be the most usual direction.

FIG. 5 illustrates the sleeve 54 of a jacket, the weft direction again being indicated as 53. In this case, lines 55 of reinforcing material have been printed on the cuff, extending nearly parallel to the weft direction 53. For making up the jacket, and also for lengthening or shortening the sleeve, the fabric of the jacket can be folded between the lines 55 or reinforcing material, the lines 55 thereby providing a good guide for making the folds.

FIG. 5 also illustrates that the lines need not be continuous and need not be equi-spaced, in particular to allow the fabric to retain more of its natural suppleness. The discontinuities between the lines 55 are distributed so that they do not line up in any direction save that aligned with the lines themselves. In this manner, the reinforcement has strong unidirectional characteristics, oriented parallel to the lines 55.

FIG. 6 illustrates the left-hand front panel 56 of a jacket which has been reinforced using the apparatus of FIGS. 1 and 2. The panel 56 need not have been cut prior to feeding it through the roll stand 1, and the lines 57 of reinforcing material extend parallel to the weft direction 53. If desired, a shaped mask can be placed on the fabric to leave blank an area 58 which serves to form a dart.

Figure 7:
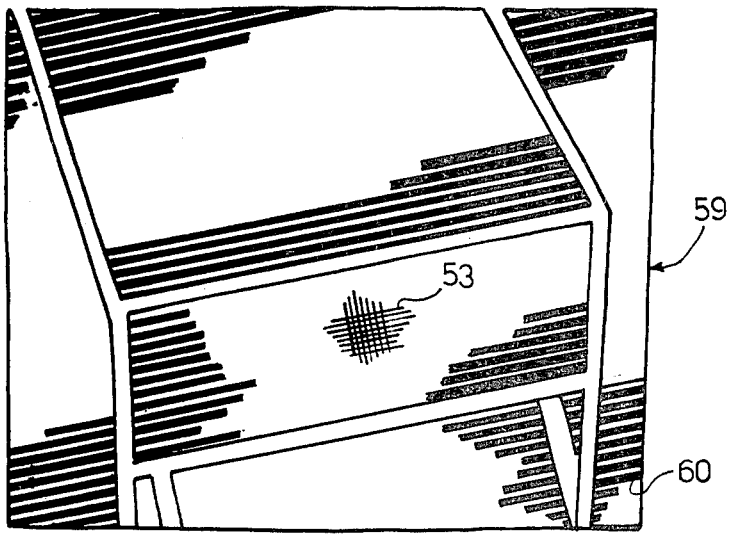

FIG. 7 illustrates the piece 59 of fabric which is used to form the breast pocket of a jacket. A shaped mask is used to leave blank wide strips which correspond to fold lines and sewing lines, facilitating folding and sewing. The lines 60 of the reinforcing material are shown extending parallel to the weft direction 53. Using a large masking sheet, a large number of the pieces 59 can be printed with reinforcing material prior to cutting the fabric, and it is found that two different sizes of breast pockets are sufficient for the whole range of sizes of jacket.

Figure 8:
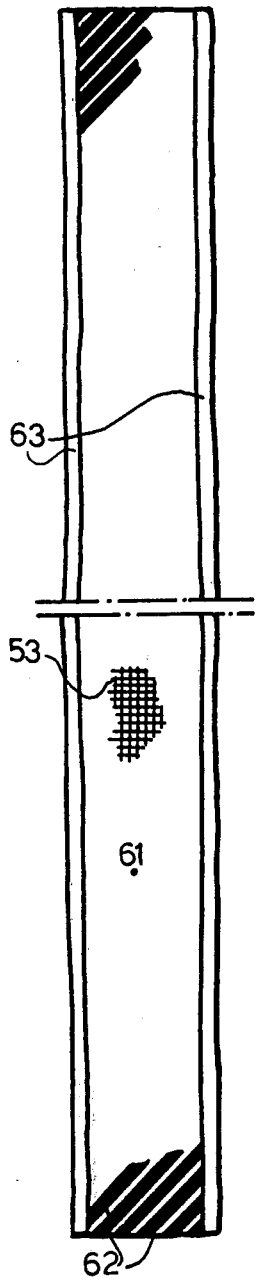

FIG. 8 illustrates the strip 60 of fabric which is used to form the belt or waist-band of a pair of trousers. A pattern of parallel lines 62 is applied along the length of the strip 61, leaving the marginal portions 63 blank, and the lines 62 preferably extend at approximately 45° to the weft direction 53 as such an orientation of the lines allows the bottom edge of the strip 61 to stretch slightly more than the top edge (to suit the shape of the waist) while somewhat increasing the strength of the strip 61 in the longitudinal direction and resisting any tendency for the top of the strip to curl over. The blank marginal portions 63 enable the edges of the strip to be sewn and folded without difficulty.

The pattern can be applied to the strip 61 in various ways. For instance, the printing cylinder 4 as described above can be used, turning the strip 61 at 45° to the axis of the printing cylinder 4 and masking the marginal portion 63. Alternatively, the lines can be incised at 45° to the circumferential direction of the printing cylinder 4, either along substantially the full length of the printing cylinder 4 (when a mask must be used) or along a length corresponding to the width of the patterned part of the strip 61.

Figure 9:
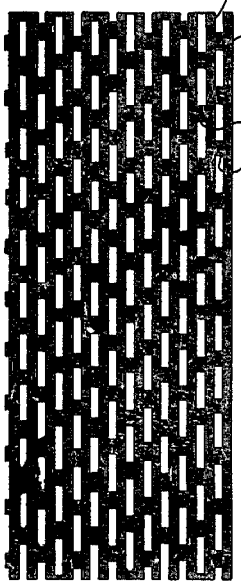
FIG. 9 illustrates a different pattern of reinforcing material which can be used in accordance with the invention.

FIG. 9 illustrates a pattern of reinforcing material which can be used at special positions, for instance on the strip 61 instead of the parallel lines illustrated in FIG. 8 or on the collar strip of a jacket, when extra strength is required, enabling the usual tapes to be omitted. The parallel lines 64 are interconnected by parts 65 which extend transversely of the lines 64, the parts 65 being distributed so that they do not line up in any direction save that aligned with the lines 64 themselves; in this manner, the reinforcement has relatively strong unidirectional characteristics, oriented parallel to the lines 64. The pattern of FIG. 9 can be incised on the printing cylinder 4, though alternatively the pattern could be applied to the fabric using a silk screen.

In general, the reinforcement imparted to the fabric can be increased by increasing the width of the lines relative to that of the spaces therebetween, and in the specific case of FIG. 9, the reinforcement can also be increased by increasing the length (as measured parallel to the lines 64) of the parts 65 relative to that of the spaces therebetween.

EXAMPLES 2 TO 13

In all the following Examples, the reinforcing material used was as set out in Example 1, and the apparatus used was as set out in FIGS. 1 and 2 of the drawings. All parts are by weight unless stated otherwise.

| Ex. No. | Type of fabric | Fabric constitution | Fabric construction | Fabric weight gms/m² | Type of printing | Roll gap mm | Roll pressure | Weight of cured resin per unit area of fabric gms/m² | Weight of cured resin per meter of line, gms/m | Preportion of cured resin to fabric % by weight |
|---|---|---|---|---|---|---|---|---|---|---|
| 2 | Jacket top cloth | 100% wool | woollen, woven | 336 | single | 0.15 | medium | 50.7 | 0.10 | 14 |
| 3 | Cloth for trousers | 45:55 wool: polyester | worsted, woven | 325 | single | 0.15 | " | 33.4 | 0.07 | 10 |
| 4 | Knickerbocker cloth for suits | 100% wool | woollen, woven | 357 | single | 0.15 | " | 32.9 | 0.06 | 9 |
| 5 | Foulard cloth for suits | 100% wool | worsted, woven | 253 | single | 0.12 | heavy | 28.6 | 0.06 | 11 |
| 6 | Serge cloth for ladies' suits | 50:50 rayon: polyester | worsted, woven | 226 | single | 0.12 | " | 40.8 | 0.08 | 18 |
| 7 | Ladies' overcoat cloth | 35:65 wool: acrylic | double-face weave (double weft), wholly worsted on front, woollen on back | 367 | single | 0.20 | medium | 50.3 | 0.10 | 14 |
| 8 | Collar lining | 70:30 wool: rayon | felt | 159 | single | 0.15 | heavy | 67.6 | 0.13 | 42 |
| 9 | " | " | " | " | double, crossed on same side | 0.15 | " | 96.7 | (0.09) | 61 |
| 10 | Felt interlining | 40–60 wool: rayon | " | 107 | single | 0.15 | " | 45.6 | 0.09 | 42 |
| 11 | " | " | " | " | double, parallel on same side | 0.15 | " | 86.1 | 0.08) | 81 |
| 12 | " | " | " | " | double, crossed on same side | 0.15 | " | 94.5 | (0.09) | 83 |
| 13 | Fabric for ladies' dresses | viscose acetate | woven from continuous filaments | 80 | single | 0.15 | very light or none | 16.2 | 0.04 | 20 |

I claim:

1. A method of reinforcing a fabric comprising, providing a printing member having a printing face defining 0.05–1 mm deep blind grooves therein, said grooves forming a printing pattern, locating a backing member a predetermined distance from said printing member to receive said fabric therebetween, supplying fluid, settable or curable, reinforcing material to said grooves, said fluid reinforcing material having a Brookfield viscosity of between 10,000 and 25,000 centipoise, feeding a fabric having a thickness at least equal to said predetermined distance between said backing member and said printing member and maintaining said predetermined distance during the entire printing operation so that said printing face engages a face of said fabric located between said printing member and said backing member with a pressure dependent on said thickness thereby printing an amount of said fluid reinforcing material onto said fabric and penetrating said fluid reinforcing material into said fabric a distance dependent on said pressure in a pattern corresponding to said pattern on said printing member and substantially setting or curing said pattern of reinforcing material to form an elastomeric or plastics material firmly adhering to and reinforcing said fabric.

2. The method as claimed in claim 1, wherein said Brookfield viscosity is between 13,000 and 20,000 centipoise.

3. The method as claimed in claim 1, wherein said Brookfield viscosity is between 15,000 and 17,000 centipoise.

4. The method as claimed in claim 1, wherein said Brookfield viscosity is about 16,000 centipoise.

5. The method as claimed in claim 1, wherein said grooves are about 1 mm wide.

6. The method as claimed in claim 1, wherein said grooves are 0.25 to 0.35 mm deep.

7. The method as claimed in claim 1, wherein said backing member is adjusted relative to said printing member to define a predetermined gap having a width of between 0.1 and 0.5 mm.

8. The method as claimed in claim 1, wherein said reinforcing material is a heat-settable or heat-curable polyacrylic-type resin having a melaminic cross-linking agent.

9. The method as claimed in claim 1, wherein said pattern of reinforcing material on said fabric is comprised of lines and the weight of one of said lines of set or cured material on said fabric is between 0.04 and 0.15 grams per meter of line.

10. The method as claimed in claim 1, wherein the weight of the set or cured reinforcing material on said fabric is between 15 and 60 grams per square meter of said fabric.

11. The method as claimed in claim 1, wherein the weight of the set or cured reinforcing material on said fabric is between 7.5% and 20% of the weight of the fabric as weighed without said reinforcing material.

12. The method as claimed in claim 1, wherein the printing member is a printing cylinder having a cylindrical surface defining said printing pattern and the backing member is a backing roll, there being a gap of 0.1 to 0.5 mm between the printing cylinder and the backing roll when the printing cylinder cooperates with the fabric.

13. The method as claimed in claim 1, wherein the printing member is a printing cylinder having a cylindrical surface defining said printing pattern and the backing member is a backing roll and wherein the fabric is moved past the printing cylinder and the gap between the printing cylinder and the backing roll is altered from a printing gap in which the backing roll urges the fabric into contact with the printing cylinder and a large gap in which the fabric does not come into contact with the printing cylinder thereby printing the fluid reinforcing material on at least one limited discrete area of the fabric.

14. The method as claimed in claim 1, wherein the printing member is a printing cylinder having a cylindrical surface defining said printing pattern, said grooves being parallel to the axis of the printing cylinder.

15. The method as claimed in claim 1, wherein said grooves are parallel and spaced about 1 mm apart.

16. The method as claimed in claim 1, wherein the fabric is woven fabric having a warp and a weft and said grooves are parallel and extend parallel to the weft of the fabric whereby parallel lines of reinforcing material are printed onto the fabric and extend parallel to the weft of the fabric.

17. The method as claimed in claim 1, wherein said grooves are 0.25 to 1 mm deep.

18. A method for reinforcing a plurality of different types of fabric comprising, providing a printing member with a printing face having 0.05 to 1 mm deep blind grooves, said grooves forming a printing pattern, adjustably locating a backing member relative to said printing member to define a predetermined gap therebetween for receiving said fabric, supplying fluid, settable or curable, reinforcing material to said grooves, said fluid reinforcing material having a Brookfield viscosity of between 10,000 and 25,000 centipoise, engaging said printing face of said printing member with a face of a first fabric having a thickness at least equal to said predetermined gap disposed between said backing member and said printing member with a pressure dependent on the thickness of the fabric while maintaining said gap constant thereby printing said fluid reinforcing material onto said fabric and penetrating said fluid reinforcing material into said fabric, substantially setting or curing said reinforcing material on said fabric to form an elastomeric or plastics material firmly adhering to and reinforcing said fabric, engaging said printing face of said printing member with a face of a second different fabric having a thickness different from the thickness of said first fabric and at least equal to said predetermined gap disposed between said printing member and said backing member with a pressure dependent on the thickness of the second fabric while maintaining the same gap constant and using the same fluid reinforcing material and speed of application thereby obtaining a different degree of penetration of said fluid reinforcing material into said second fabric and substantially setting or curing said reinforcing material on said second fabric to form an elastomeric or plastics material firmly adhering to and reinforcing said second fabric.

19. The method as claimed in claim 18, wherein said gap is between 0.1 and 0.5 mm.

20. The method as claimed in claim 18, wherein said gap is about 0.15 mm.

* * * * *